US007269858B2

(12) United States Patent
Rothschild

(10) Patent No.: US 7,269,858 B2
(45) Date of Patent: Sep. 18, 2007

(54) HIGHLY ABSORBENT/QUICK DRYING BIB

(76) Inventor: Deborah V. Rothschild, 49 Millay Rd., Morganville, NJ (US) 07751

( * ) Notice: Subject to any disclaimer, the term of this patent is extended or adjusted under 35 U.S.C. 154(b) by 89 days.

(21) Appl. No.: 11/203,656

(22) Filed: Aug. 8, 2005

(65) Prior Publication Data

US 2006/0026729 A1 Feb. 9, 2006

Related U.S. Application Data

(60) Provisional application No. 60/599,158, filed on Aug. 6, 2004.

(51) Int. Cl.
*A41B 13/10* (2006.01)

(52) U.S. Cl. ..... 2/49.4

(58) Field of Classification Search ..... 2/48, 2/49.1, 49.4, 49.2, 49.3, 49.5, 50, 51, 52, 2/46

See application file for complete search history.

(56) References Cited

U.S. PATENT DOCUMENTS 3,979,776 A * 9/1976 Gruenwald ..... 2/49.1
4,733,411 A * 3/1988 Foti ..... 2/49.1
4,811,428 A * 3/1989 Waldman et al. ..... 2/49.3
5,306,267 A * 4/1994 Hahn et al. ..... 604/378
5,490,289 A * 2/1996 Lehrer ..... 2/49.2
5,718,589 A * 2/1998 McCracken et al. ..... 434/159
5,802,610 A * 9/1998 Burr ..... 2/49.4
5,887,278 A * 3/1999 Lewis et al. ..... 2/49.1
6,237,150 B1 * 5/2001 Lucas ..... 2/49.1
6,308,333 B1 * 10/2001 Jackson ..... 2/49.4
2001/0047532 A1 * 12/2001 Marrero ..... 2/49.1
2005/0144693 A1 * 7/2005 Hagen ..... 2/49.1
2005/0241043 A1 * 11/2005 Willis ..... 2/49.1

* cited by examiner

*Primary Examiner*—A. Vanatta
(74) *Attorney, Agent, or Firm*—Charles I. Brodsky

(57) ABSTRACT

A reversible, multi-purpose bib exhibits a polyester layer on one side for use in absorbing drool, a vinyl layer on an opposing side for use when feeding solid food, and a removable overlying cotton or cotton polyester blend layer atop the vinyl layer for use when formula feeding.

8 Claims, 6 Drawing Sheets

HIGHLY ABSORBENT/QUICK DRYING BIB

CROSS-REFERENCE TO RELATED APPLICATIONS

A provisional application describing this invention was filed Aug. 6, 2004 and assigned Ser. No. 60/599,158.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to the field of bib construction, in general, and to a fast drying bib especially useful for teething and feeding infants and toddlers.

2. Description of the Related Art

As is understood, bibs are sometimes worn by feeding adults in a nursing home setting, and are almost always worn by feeding infants and toddlers. With infants and toddlers, it is not unusual to have to change the bibs up to 10-15 times a day—not only because of the food which drips upon the bib, but because teething infants and toddlers, tend to drool almost all the time. As will be appreciated, such regular changing of bibs is necessary in order to keep the infant's or toddler's underclothes dry and to keep the infant or toddler from becoming unduly wet. This is particularly important in cold weather locations. Because infants and toddlers tend to teethe for many months, beyond one-year of age, the situation becomes quite frustrating for a mother to continue to have to wash the infant's or toddler's clothes and body over-and-over again because of the limited protection conventional bibs offer.

OBJECTS OF THE INVENTION

It is an object of the invention to provide a fast drying bib for teething and feeding infants and toddlers.

It is an object of the present invention, also, to provide such a bib which can be kept on all day without the child developing a rash from sitting or lying in moisture.

It is a further object of the invention to provide such a bib which can be sized to fit the child from birth through the toddler years.

SUMMARY OF THE INVENTION

The present invention encompasses a bib design which both absorbs moisture and dries very fast. Such characteristics, first of all, minimize any tendency for drool to flow right off the bib, onto clothing. By quickly drying, the bib can be reused throughout the day, enabling it to be simply washed at night in the kitchen, before being used again. Absorption of any drool deposited on the surface of the bib thus follows, to the extent that the construction set out could also be employed for placemats, floor mats and other instances where high absorption and quick drying is advantageous—although the present invention is particularly beneficial, more easily understood and more universally needed when utilized in bib design.

As will be seen from the following description, the highly absorbent/quick drying bib of the invention in its simplest form includes a top layer of polyester, a bottom layer of vinyl and an intermediate layer of one of cotton and polyester cotton adhesively laminated at a top surface thereof to the top layer of polyester and at a bottom surface thereof to the bottom layer. First means are included to join together overlapping edge surfaces of the layers when lain atop one another in bib configuration with the neck encompassing section extending from a body section, and second means are included on one of the top and bottom layers for selectively closing and opening the neck section for the wearing and removal of the bib. As will be appreciated by those skilled in the art, with the bib worn with its top layer of polyester facing out, drool can be absorbed, but with quick drying without any penetration of the clothing being worn. With the bib being worn with the bottom layer of vinyl facing out, formula and/or solid foods run down the surface of the layer, without absorption.

In a second embodiment of the invention, to be described, an auxiliary layer of a 100% cotton or cotton polyester blend is removably secured to the bottom layer of vinyl for absorbing formula when the vinyl layer is otherwise worn facing out—with the cotton or cotton polyester blend layer then being removed when it is time for solid feeding.

As will be appreciated, a multi-purpose bib results, from the reversible nature of the bib construction.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
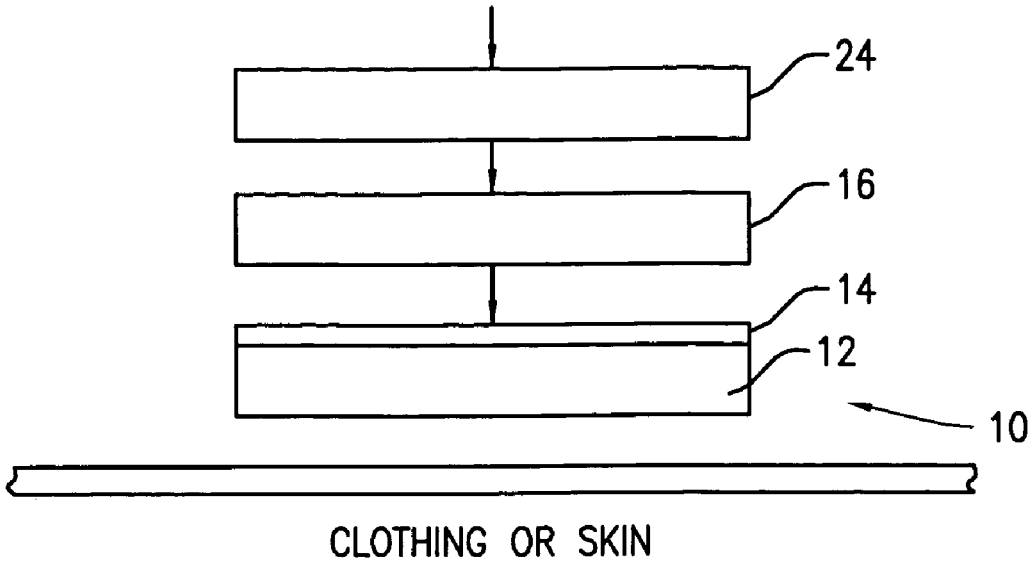
FIGS. 1 and 2 illustrate two separate modes of manufacturing compositions for the bib embodying the teachings of the invention.
Figure 2:
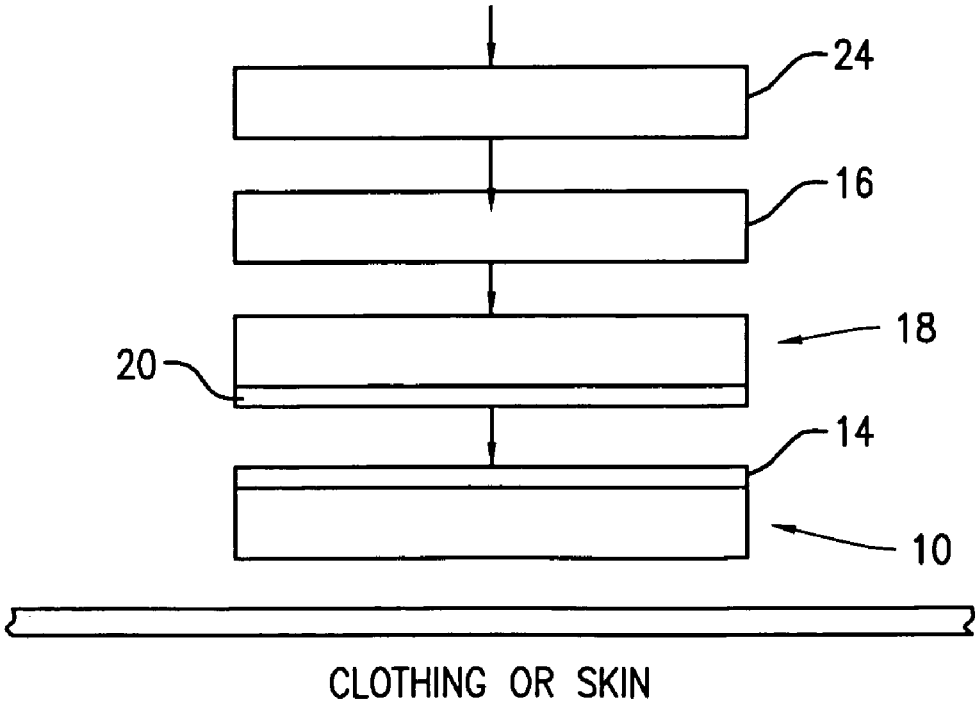

In the FIG. 1 embodiment, a trilaminate of materials are employed, while in the embodiment of FIG. 2, a quad-laminate is utilized. In each, a bottom layer (to be worn against the clothing of the body) is shown at 10, being composed of a primarily vinyl type material, such as one of polyvinylchloride composition 12 with a non-woven polyester backing 14. In the embodiment of FIG. 1, adhesively laminated to the bottom layer 10, at the backing 14, is an intermediate layer 16 of 100% cotton or polyester cotton. In the embodiment of FIG. 2, on the other hand, a further layer 18 is interspersed between the bottom layer 10 and the layer 16—composed like the bottom layer 10 of polyvinylchloride and non-woven polyester, with a non-woven polyester backing 20 of the layer 18 being joined with the backing 14 of the layer 10, and with the layer 18 being adhesively laminated to the cotton or polyester cotton layer 16. In each of the FIGS. 1 and 2 embodiments, a further layer 24 of 100% polyester is adhesively laminated to the layer 16. As will be understood, the 100% polyester layer 24 faces outwardly, away from the clothing and skin.

In these respects, the top polyester layer 24 is both highly absorbent and fast drying. Any moisture that might pass through the layer 24, however, is then absorbed by the cotton or polyester cotton layer 16, which also gives body and strength to the bib fabric. The bottom layer 10 absorbs any moisture that might pass through the layer 16—while the intermediate layer 18 when employed further ensures that the wetness does not pass through to the clothing and skin. At the same time, such second vinyl-polyester layer 18 gives added strength to the structure—and a nicer, smoother join follows by aligning the two non-woven polyester backings 14, 20 adjacent one another. When fabricating the bib of such construction, any appropriate trim can be employed, such as a polyester-cotton mix, or just a cotton trim alone, being sewn on. While a Velcro adhesive-and-loop join can be utilized in hanging the bib around the infant's (or adjust's) neck, to minimize any irritation the might result, a snap or button closure may be used instead.

Any type of adhesive lamination may be employed in forming the trilaminate or quad-laminate constructions, and any manner of carrying out the laminating steps could be employed. Whether the bottom layer 10 is first laminated to the layer 16 before the layer 16 is laminated to the layer 24 in the FIG. 1 embodiment, or vice versa, or whether it is first laminated to the intermediate layer 18 before that layer 18 is laminated to the layer 16 in the embodiment of FIG. 2, for example, is irrelevant to the end result of the present construction's having a highly absorbent, quick drying material useful as a bib for adults or, particularly, teething infants.

Figure 3:
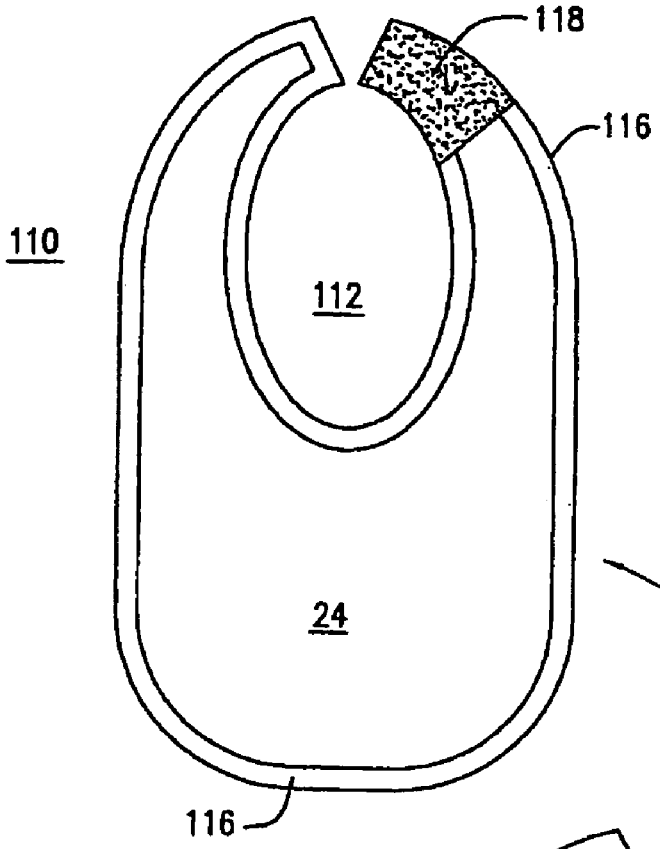
FIGS. 3 and 4 are front and rear views of the basic construction of the bib, with the top layer of polyester and the bottom layer of vinyl, respectively.
Figure 4:
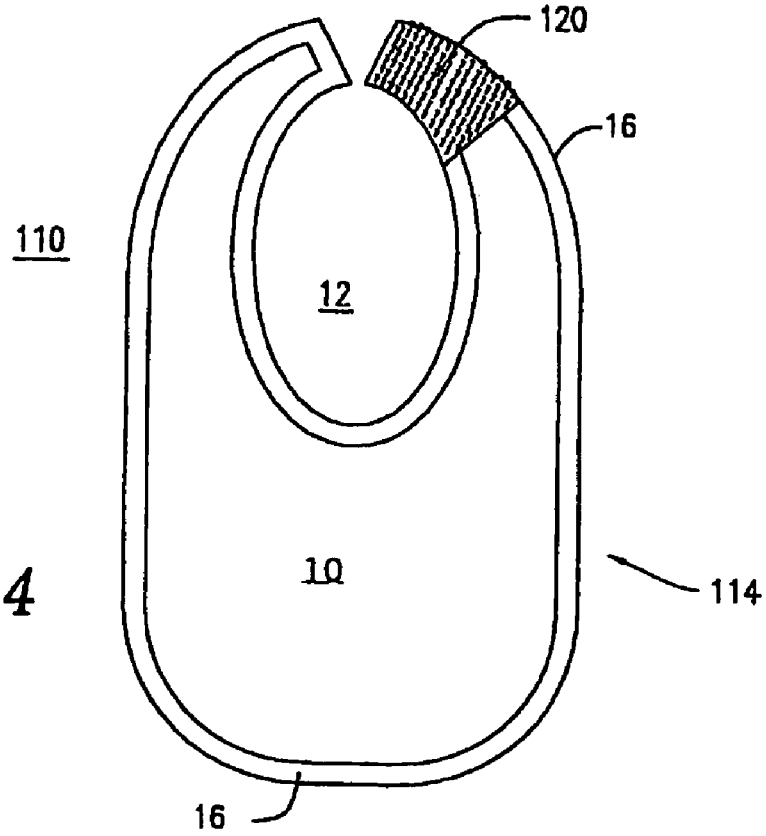

FIG. 3 illustrates the laminate construction of the invention formed as a bib 110. Reference numeral 112 represents the neck encompassing section of the bib, while reference numeral 114 represents the body section of the bib. First means 116 joins together the overlapping edge surfaces of the layers when lain atop one another, as by sewing. Understanding that the body section 114 here displays the top layer of polyester 24, second means, preferably in the form of a hook-and-loop Velcro adhesive couple between opposing portions of the neck encompassing section 112 to fit the neck opening to size. One component of the hook-and-loop adhesive coupling is shown at 118 in FIG. 3, whereas the second component of the adhesive coupling is shown at 120 in FIG. 4. In FIG. 4, moveover, it will be appreciated that the body section 114 is that of the layer of vinyl 10.

Figure 5:
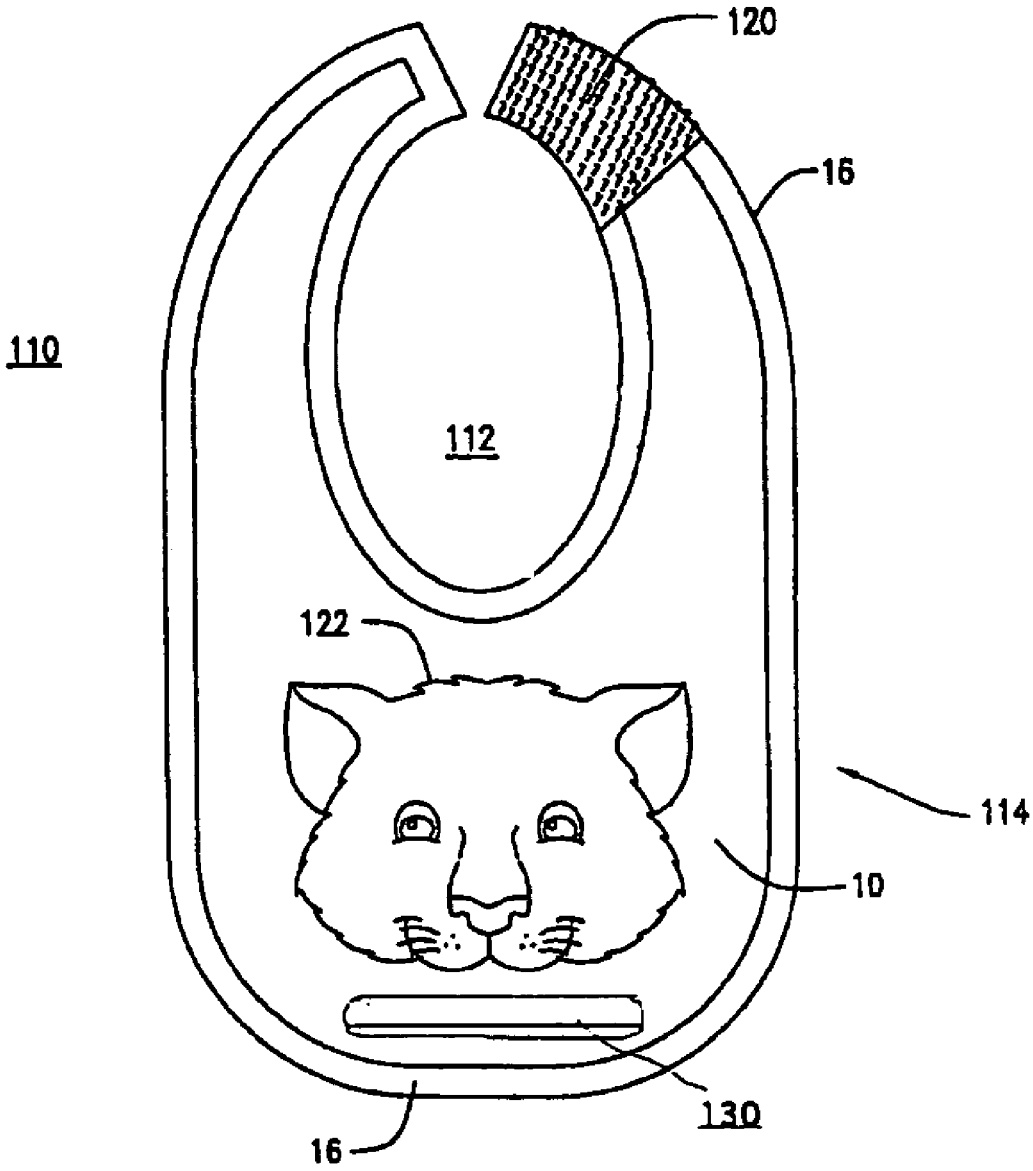
FIG. 5 is a modified view of the vinyl side of the bib of FIG. 4, illustrating the additional auxiliary layer of a cotton or cotton polyester blend.

As will be understood, in the bib construction of FIGS. 3 and 4, infant drool would be absorbed by the top layer of polyester 24. As the child progresses to the toddler stage, and is fed formula, the bib 110 is worn with the vinyl layer 10 of FIG. 4 facing outwardly, and none of the formula that runs down is absorbed. In the configuration of FIG. 5, on the other hand, an auxiliary layer of 100% cotton or cotton polyester blend 122 is removably secured to the vinyl layer 10, through a like hook-and-loop Velcro adhesive coupling at its underside to absorb such formula run-off. As the child progresses to solid food, the cotton or cotton polyester blend layer 122 can be peeled off to fully expose the underlying vinyl layer 10, and can instead be used to wipe the child's face. While FIG. 5 illustrates only the top portion of the body section 114 being covered, leaving a "catch pocket" 130, the cotton or cotton polyester blend layer 122 could alternatively overlie the entire vinyl layer 10. After feeding solid food, the vinyl portion can again be easily wiped clean.

Figure 6:
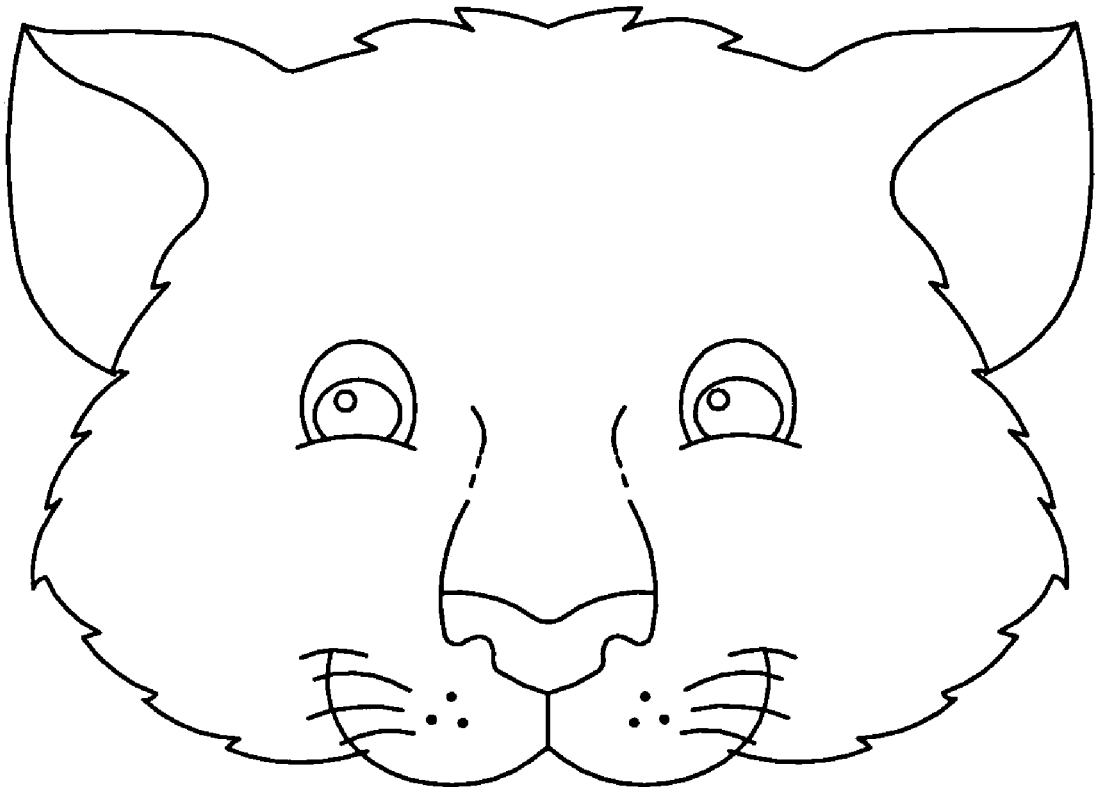
FIGS. 6-8 depict illustrations of animal head shapes which may be utilized as the cotton or cotton polyester blend layer of FIG. 5.
Figure 7:
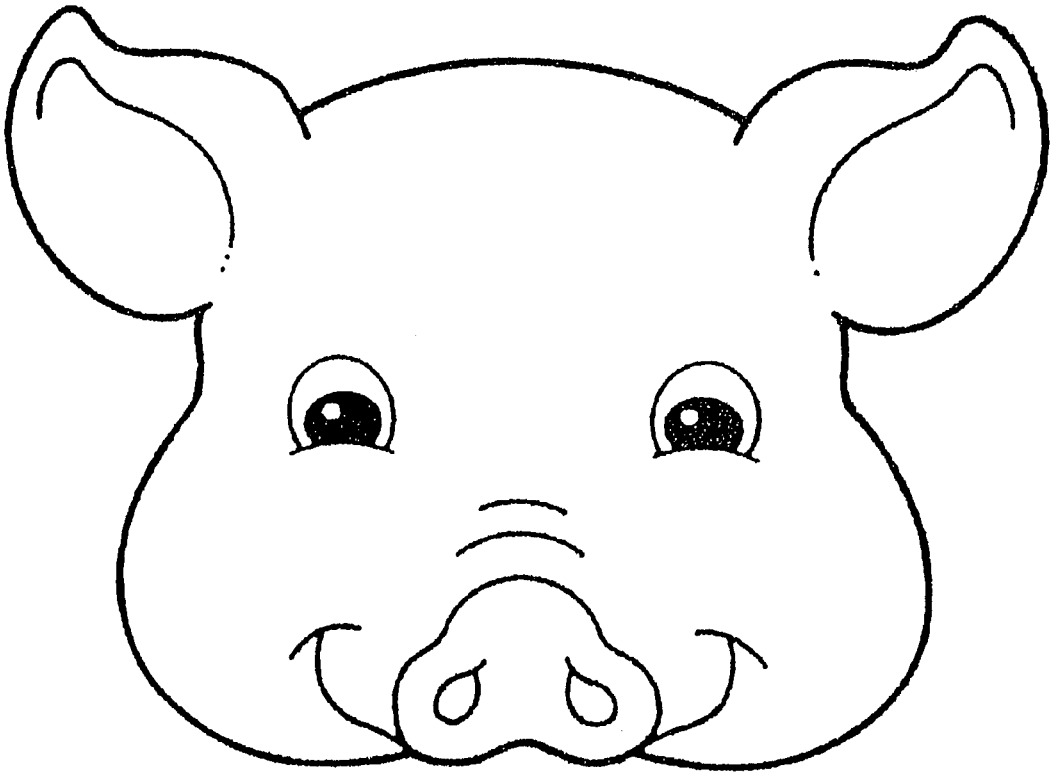
Figure 8:
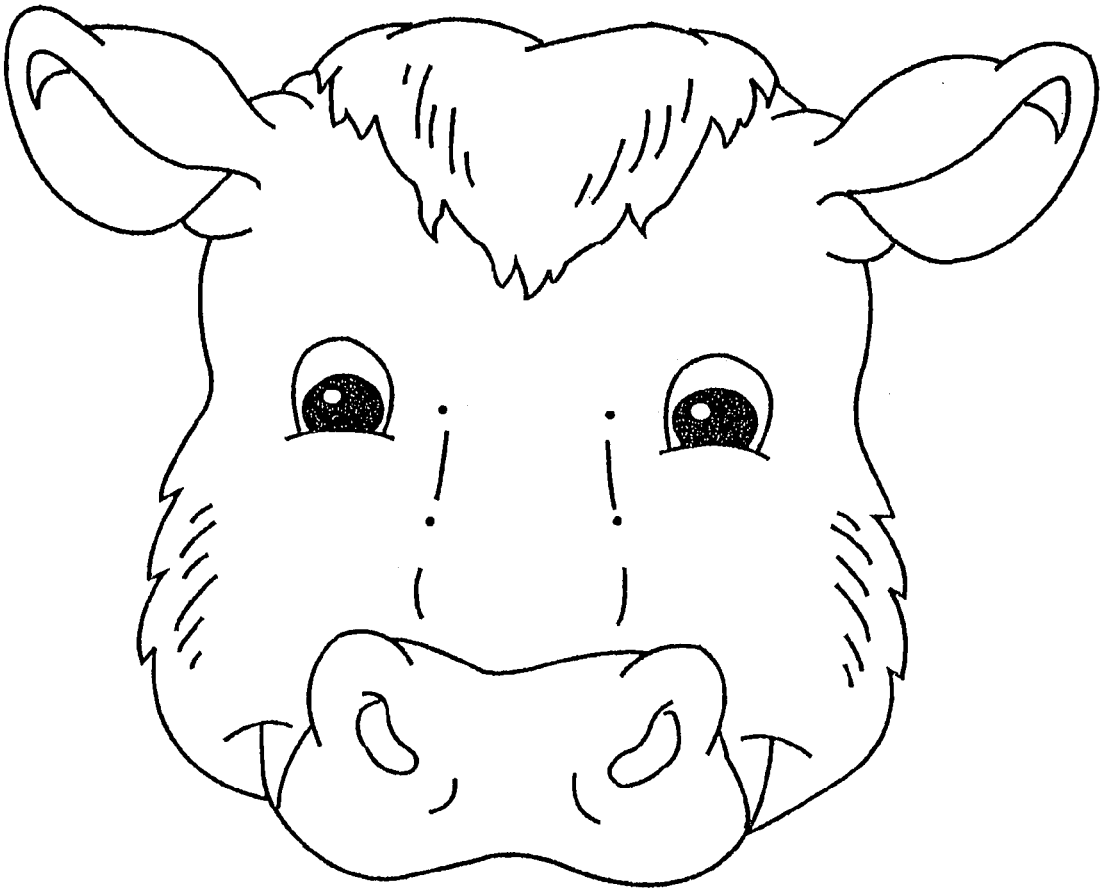

While FIG. 5 illustrates the cotton or cotton polyester blend layer 122 as being in the configuration of an animal's head, any desired shape could be used instead. Animal head shapes as in FIGS. 6, 7 and 8 have been accepted as being recognizable by a growing child, and each with a Velcro coupling to the vinyl layer 10 presents an interchangeable auxiliary coupling so that a dry bib is always available at a mother's disposal.

From a standpoint of marketing the bib of the invention, a package has been determined to be attractive for sales including the bib along with a plurality of these interchangeable auxiliary layers of cotton or cotton polyester blend in recognizable shapes. An inclusion of three such shapes as in FIGS. 6, 7 and 8 has been found to be highly acceptable. As will be understood, with the cotton or cotton polyester blend inclusion, one bib a day can be seen to be all that is required to keep the moisture away from the child, from birth through the toddler years. By having the two component Velcro adhesive coupling design 118, 120, the bib can be sized to fit from birth onward. Available under the Trademark "Dribble Bibble", the bib of the invention will be seen to have a multi-purpose use, while keeping the underlying clothing dry.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A multi-purpose, reversible bib comprising:

a top layer of polyester, a bottom layer of vinyl, and an intermediate layer of one of cotton and polyester cotton joined at a top surface thereof to said top layer of polyester, and joined at a bottom surface thereof to said bottom layer of vinyl;

first means joining together overlapping edge surfaces of said layers when lain atop one another in bib configuration with a neck encompassing section extending from a body section; and second means on one of said top layer of polyester and said bottom layer of vinyl for selectively closing and opening said neck encompassing section for the wearing and removal of said bib wherein said top layer of polyester, when said bib is being worn with said bottom layer of vinyl against the body, faces out to absorb drool and spit-up without penetration of the clothing being worn, and wherein said bottom layer of vinyl, when said bib is being worn with said top layer of polyester against the body, faces out to be wiped clean of food during solid feeding, without absorption into the bib.

2. The multi-purpose, reversible bib of claim 1 wherein said first means sews together said edge surfaces of said top, bottom and intermediate layers.

3. The multi-purpose, reversible bib of claim 1 wherein said second means includes a hook-and-loop adhesive coupling between opposing portions of said neck encompassing section.

4. The multi-purpose, reversible bib of claim 1, also including an auxiliary layer of one of a 100% cotton or cotton polyester blend removably secured to said bottom layer of vinyl along a surface remote from said intermediate layer.

5. The multi-purpose, reversible bib of claim 4 wherein said auxiliary layer is removably secured to said bottom layer of vinyl by a hook-and-loop adhesive coupling.

6. The multi-purpose, reversible bib of claim 5 wherein said auxiliary layer is in the shape of an animal head.

7. The multi-purpose, reversible bib of claim 1, also including a pocket on said bottom layer of vinyl to catch food wiped from said vinyl layer.

8. The multi-purpose, reversible bib of claim 7 wherein said pocket overlies at least a lower portion of said bottom layer of vinyl.

* * * * *